US009144966B2

(12) United States Patent
Zagar et al.

(10) Patent No.: US 9,144,966 B2
(45) Date of Patent: Sep. 29, 2015

(54) COMBINED CHILLER AND SPREADER ROLL ASSEMBLY

(71) Applicants: Lawrence E Zagar, Dover, NH (US); James Brian Vrotacoe, Barrington, NH (US); Daniel Matthew Perdue, McKinney, TX (US)

(72) Inventors: Lawrence E Zagar, Dover, NH (US); James Brian Vrotacoe, Barrington, NH (US); Daniel Matthew Perdue, McKinney, TX (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 14/043,973

(22) Filed: Oct. 2, 2013

(65) Prior Publication Data

US 2014/0102323 A1 Apr. 17, 2014

Related U.S. Application Data

(60) Provisional application No. 61/713,297, filed on Oct. 12, 2012.

(51) Int. Cl.

| | |
|---|---|
| ***B41F 13/02*** | (2006.01) |
| ***B41F 23/04*** | (2006.01) |
| ***B65H 23/025*** | (2006.01) |
| ***B65H 27/00*** | (2006.01) |

(52) U.S. Cl.

CPC ..... *B41F 23/0479* (2013.01); *B41F 13/02* (2013.01); *B65H 23/025* (2013.01); *B65H 23/0258* (2013.01); *B65H 27/00* (2013.01); *B65H 2301/5144* (2013.01); *B65H 2404/1371* (2013.01); *B65H 2801/21* (2013.01)

(58) Field of Classification Search

CPC .. B41F 23/0479; B41F 23/0409; B41F 13/02; B65H 23/0258; B65H 27/00; B65H 2301/5144; B65H 2404/1371; F16C 13/003

See application file for complete search history.

(56) References Cited

U.S. PATENT DOCUMENTS

| | | | | |
|---|---|---|---|---|
| 4,803,877 | A * | 2/1989 | Yano | 72/248 |
| 4,870,731 | A * | 10/1989 | Yano | 492/16 |
| 6,042,525 | A | 3/2000 | Rajaniemi | |
| 6,058,844 | A | 5/2000 | Niemiec | |
| 6,250,220 | B1 | 6/2001 | Sainio et al. | |
| 6,606,948 | B1 | 8/2003 | Austin et al. | |
| 6,843,762 | B2 | 1/2005 | Munche et al. | |

* cited by examiner

*Primary Examiner* — Blake A Tankersley

(74) *Attorney, Agent, or Firm* — Davidson, Davidson & Kappel, LLC

(57) ABSTRACT

A roller assembly is provided for spreading and chilling a web in a printing press. The roller assembly includes a roller for chilling and spreading a web and a trolley roller contacting the roller, the trolley roller configured and arranged to impart a deflection in the roller. Also provided is a roller assembly for counteracting web loading on a roller in a printing press. This roller assembly includes a roller for transporting a web, the roller having an axis; a web wrapped partially around the roller and applying a load on the roller transverse to the axis; and a trolley roller contacting the roller, the trolley roller configured and arranged to impart a sufficient force on the roller to keep the axis of the roller linear under said load.

17 Claims, 2 Drawing Sheets

Example of a (3) Roll System with UV Curing Stations.

COMBINED CHILLER AND SPREADER ROLL ASSEMBLY

This application claims priority to U.S. Provisional Patent Application Ser. No. 61/713,297, filed Oct. 12, 2012, the entire disclosure of which is hereby incorporated by reference.

BACKGROUND

The present invention relates generally to printing press equipment.

U.S. Pat. Nos. 6,042,525, 6,058,844, 6,250,220 and 6,843,762 purportedly disclose spreader rollers for use with a printed web in a printing press. Spreader rollers are often used to eliminate or reduce wrinkles and/or tearing in the web and web fluting. The spreader rollers may include bowable shafts, bow rolls, and interconnected cylinder elements. The shafts or segments may be mounted on rolls via bearings.

U.S. Pat. No. 6,606,948 discloses a method for controlling a chill roll system. The method prevents post-chill marking by sufficiently cooling the web, and sets chill roll temperature profiles to avoid solvent condensation on chill roll surfaces and to avoid condensate marking.

BRIEF SUMMARY OF THE INVENTION

In accordance with a first embodiment of the present invention, a roller assembly is provided for spreading and chilling a web in a printing press. The roller assembly includes a roller for chilling and spreading a web and a trolley roller contacting the roller, the trolley roller configured and arranged to impart a deflection in the roller. In accordance with another aspect of this embodiment, the axis of the roller is preferably non-linear under said deflection.

In accordance with a second embodiment of the present invention, a roller assembly is provided for counteracting web loading on a roller in a printing press. The roller assembly includes a roller for transporting a web, the roller having an axis; a web wrapped partially around the roller and applying a load on the roller transverse to the axis; and a trolley roller contacting the roller, the trolley roller configured and arranged to impart a sufficient force on the roller to keep the axis of the roller linear under said load.

In accordance with another aspect of the first and second embodiments, the roller assembly may include an actuator connected to the roller. In the case of the first embodiment, the actuator causes the trolley roller to impart the deflection. In the case of the second embodiment, the actuator causes the trolley roller to impart the sufficient force.

In accordance with another aspect of the first and second embodiments, the roller assembly may include a web wrapping around the roller, the trolley roller contacting the roller in an area where the web is not present.

In accordance with another aspect of the first and second embodiments, the trolley roller may contact the roller substantially at a mid-span of the roller.

In accordance with another aspect of the first and second embodiments, the ends of the roller preferably are not deflected by the contact.

In accordance with another aspect of the first and second embodiments, the roller assembly may further include a light source positioned to transmit light towards the roller, whereby the light source cures ink on a web as it passes over the roller. The light source may, for example, be an ultraviolet light source.

In accordance with another aspect of the first and second embodiments, the roller may be a flexible roller having an outside diameter of from about 4 inches to about 10 inches, preferably from about 7 inches to about 8 inches. In this regard, the flexible roller may have an outer shell defining said outside diameter. Preferably, the outer shell has a wall thickness of about 0.3+/−0.2 inches, and may, for example, be made of aluminum.

In accordance with a third embodiment of the present invention, a printing press is provided which includes a printing section for printing on a web and one or more roller assemblies according to the first and/or second embodiment described above.

In accordance with a fourth and fifth embodiment of the present invention, a method for spreading and chilling a web comprises the steps of passing a web over the roller assembly of the first embodiment, and a method for counteracting web loading on a roller in a printing press comprises the steps of passing a web over the roller assembly of the second embodiment In accordance with a sixth embodiment of the present invention, a method for minimizing fluting in a web comprising the steps of: passing a web over a roller, the roller chilling the web; contacting the roller with a trolley roller causing the roller to deflect; and spreading the web due to the deflection of the roller. The roller may, for example, be the roller according to the first or second embodiments described above.

In accordance with a seventh embodiment of the present invention, a roller assembly for spreading and chilling a web in a printing press comprises a roller for chilling and spreading a web; and means for imparting a deflection in the roller.

BRIEF DESCRIPTION OF THE DRAWINGS

A preferred embodiment of the present invention will be elucidated with reference to the drawings, in which.

DETAILED DESCRIPTION OF PREFERRED EMBODIMENTS

When thin webs, films or other thin substrates pass through a printing press, troughs or fluting may develop in the web, film or substrate. Shaped rollers or spreader rollers may be used to maintain flatness in the web. Bowed axis spreader rollers, bow tied or parabolic shaped rolls and/or smaller diameter aluminum chill rolls with non-metallic inserts may be used to maintain the flatness of the web or substrate.

Chill rolls and bowed axis rolls are typically employed in web printing press to achieve chilling and spreading results, respectively. Profiled chill rolls, for example, bow-tie or concave parabolic chill rolls may be effective in spreading but may also introduce downstream out-of-plane web deformations. In addition, profiled chill rolls may introduce laterally varying circumferential strains in the web that can be permanently "ironed" in or set when utilized in the dryer-chill span. Profiling was added to small diameter aluminum chill rolls because web tension caused excessive unfavorable roll bending.

Large diameter cylindrically shaped chill rolls result in a significant amount of air entrainment that causes micro-fluting in thin films or thin substrates. Micro-fluting results in uneven cooling and substrate deformation when combined with ultra-violet curing. A profiled chill roll does not prevent micro-fluting when printing thin films or substrates. As one of ordinary skill in the art will appreciate, a large diameter chill roll is a chill roll with a diameter of about 14.5 inches or larger.

Small diameter flexible/bendable chill rolls do not produce desired results from a web wrinkling perspective. Concave idlers are used to spread substrates upstream of the chill roll, however, the idlers can produce downstream out-of plane deformations. A bowed axis spreader roller may be employed just upstream of a cylindrical chill roll. As one of ordinary skill in the art will appreciate, a small diameter chill roll is a chill roll with a diameter from about 4 inches in diameter to about 10 inches in diameter, preferably from about 7 to about 8 inches in diameter.

The present invention provides a chill roll for chilling and web spreading combined into a single chill roll. A small diameter chill roll of this nature also increases the effective heat transfer coefficient due to small boundary layer height. The compactness of the single chill roll allows the roll to be used for inner-station chilling and/or drying between print units.

Figure 1:
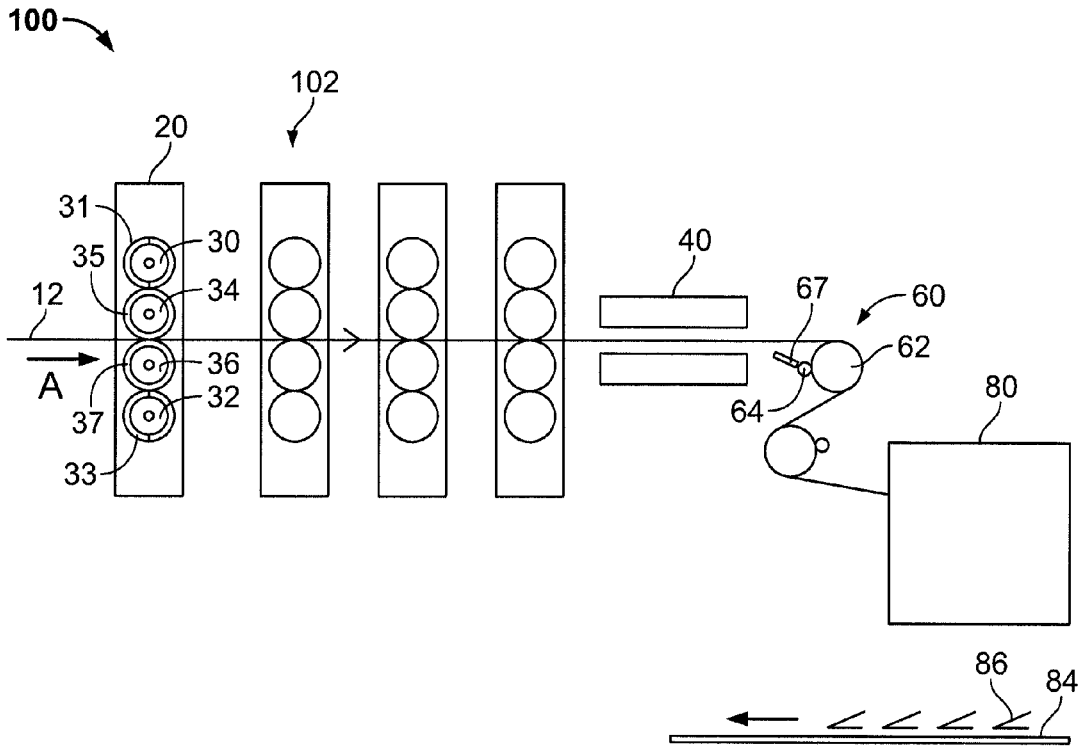
FIG. 1 shows a printing press printing on a web substrate and a chiller and spreader roll assembly according to the present invention.

FIG. 1 shows a printing press 100 including a dual function chill and spreader combination roll 60 in accordance with the present invention. Printing press 100 includes a printing section 102 which includes for example, four printing units 20, each printing unit printing a different color on a web 12. Web 12 moves through press 100 in a direction A. Each printing unit may include two print couples, one print couple located on either side of web 12. Each print couple includes one plate cylinder 30, 32 and one blanket cylinder 34, 36, respectively. Plates 31, 33 may be mounted on printing cylinders 30, 32 and blankets 35, 37 may be mounted on blanket cylinders 34, 36 respectively. Blanket and plate cylinders may be any format size, for example, one around, two around, three around, etc.

After being printed by printing section 102, web 12 passes through a dryer 40. Dryer 40 may be, for example, an infrared dryer or a hot-air dryer. A cooling process may be needed after dryer 40 since the temperature of web 12 may be heat up, to approximately 130° C., for example, thereby affecting plasticity and tackiness of the ink. Cooling may be carried out by the chill/spreader roll assembly 60. Web 12 preferably winds around chill/spreader rolls at the greatest possible angle of wrap to ensure effective cooling of the web by direct heat conduction. Web 12 then enters a folder 80 for folding, cutting and forming the web into printed products as desired. Printed products 86 are then transported further downstream via a conveyor 84 for additional processing or delivery. Web 12 can also enter a winding process rather than folding, cutting, or forming.

Figure 2:
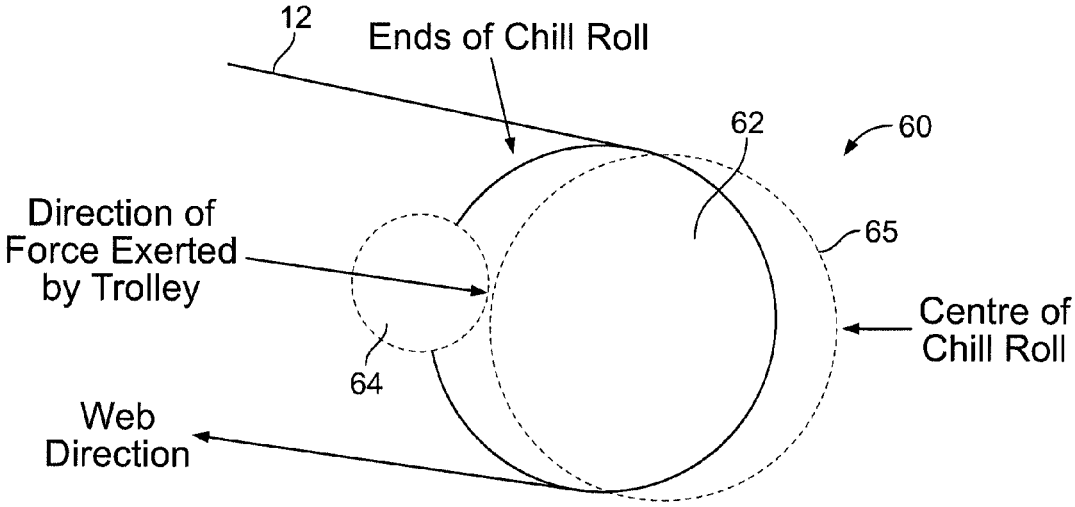
FIGS. 2 and 3 show the chiller and spreader roller assembly show in FIG. 1.
Figure 3:
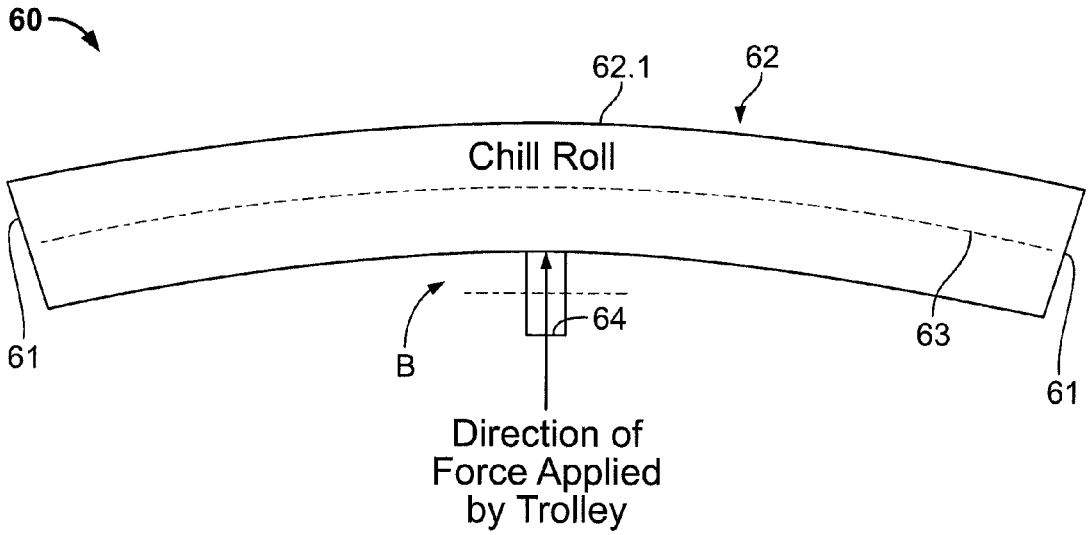

FIGS. 2 and 3 shows a closer view of a single chill/spreader roll 62 and an impinging or trolley roll 64 of single chill/spreader roll assembly 60. Trolley roll 64 is configured and arranged to apply a desired force to chill/spreader roll 62. Preferably, assembly 60 includes an actuator 67 connected to trolley roll 64, which causes trolley roll 64 to apply a desired force to chill/spreader roll 62. Assembly 60 may include a plurality of chill/spreader rolls, for example, two, three, four, etc., and a plurality of trolley rolls.

The chill/spreader roll 62 may be cylindrically shaped, have a relatively small diameter and be a flexible chill roll. The width of the chill/spreader roll 62 is dependent on the maximum web width of the printing press. For example, in current, commercially available printing presses, a "wide web" press may accommodate a web-width of up to about 120", a "mid-sized" web press may typically accommodate a web-width of between about 72 inches and 75 inches, and a "narrow web" press may typically accommodate a web-width that is less than or equal to about 40". The chill/spreader roll would therefore have a web contacting outer surface with a width from between about 40 inches to about 120 inches, depending on the press in which it is to be used. The web contacting outer surface of the chill/spreader roller may have an outer diameter of between about 4 inches and about 10 inches, and preferably about 7 or 8 inches. Flexible chill rolls are typically made of aluminum, as contrasted with stiff or rigid chill rolls which are typically made of steel. The degree of flexibility of the flexible chill roll is a function of the thickness of the metal (typically aluminum) shell 62.1 and the length. This can be determined empirically. For example, a flexible chill with an outside diameter of about 7 inches and an aluminum shell with a wall thickness of 0.3+/−0.2 would be suitable for the narrow, mid-sized, and wide-web presses discussed above. In contrast, a rigid (or non-flexible) chill roll typically has an outside diameter of between about 15 to 16 inches, is made of steel, and has a wall thickness of about 0.75-0.25"/+1.00 inches.

The trolley roll 64 contacts chill/spreader roll 62 in a mid-span area B of chill/spreader roll 62 and in area where roll 62 is not wrapped by web 12. Thus, trolley roll 64 does not contact web 12. Further, the outer surface of the trolley roll 64 is much shorter in length than the chill/spreader roll 62 so that it contacts the chill/spreader roll only in the mid-span area B. Preferably, the trolley roll 64 is a metal (for example aluminum or steel) wheel having a hard durometer elastomer outer layer, for example a 60-80 shore D elastomer, and may for example, have a width of about 2 to 3 inches. However, the particular material and construction is less important than the fact that the trolley roll 64 is rigid or stiff as compared to the flexible chill roll 62 and contacts the chill roll 62 at its mid-span area B. Trolley roll 64 imparts a force to roll 62 which causes roll 62 to deflect, resulting in roll 62 having a non-linear axis 63. (FIG. 3). Non-linear axis 63 causes web 12 to spread as web 12 runs over roll 62. As shown in FIG. 2, the mid-span region of roll 62 moves into a deflected position 65. Ends of 61 of roll 62 remain substantially in the original position indicated by the solid line.

As noted above, the wall thickness of roll 62 may be reduced in comparison to conventional rigid chill rolls in order to aid in the flexibility of roll 62. In this regard, roll 62 may have a wall thickness of about 0.3+/−0.2 inches in contrast to rigid rolls which typically have a wall thickness of about 0.75-0.25"/+1.00 inches. An internal low flow resistance support may also be added to roll 62. In this regard, as one of ordinary skill in the art will appreciate, a chill roll "chills" the web by passing water through the interior of the chill roll. Conventionally, flow resistance support is provided within the interior of the chill roll, including for example internal baffling made for example, of non-metallic inserts. These conventional flow resistance supports may be included in the roll 62.

Instead of, or in addition to trolley roll 64, other means for deflecting, bowing and/or bending roller 62 may be employed and may include applying moments at the ends 61 of roll 62 outside of the bearing supports. For example, if you apply a non-axially force in the same direction against the journal on each end 61 of chill roll 62, the chill roll 62 will bow. As an illustration, a downward force applied to the journal on each end of the chill roll will bow the chill roll so that the center of the chill roll moves upward; and an upward force applied to the journal on each end of the chill roll will bow the chill roll so that the center of the chill roll moves downward. These forces may be applied by actuators such as springs, hydraulic or pneumatic pistons, or screws, or by simply securing a load component (for example, a collar weight) to the ends 61. The means for deflecting could alternatively include other roller arrangements that deflect, bow, and/or bend roller 62.

In accordance with another embodiment of the present invention, trolley roll 64 may be used to counteract roll 62 deflection caused by web loading and the compressive forces on web 12 that tend to result in fluting. In this embodiment, the axis 63 of roll 62 remains substantially linear when under web loading. In other words, web-loading (the force applied by the web to the roller 62) will tend to deform or bow the roll 62 and may cause fluting. The trolley roll 64 may be used to counteract that deformation of the roll 62.

Figure 4:
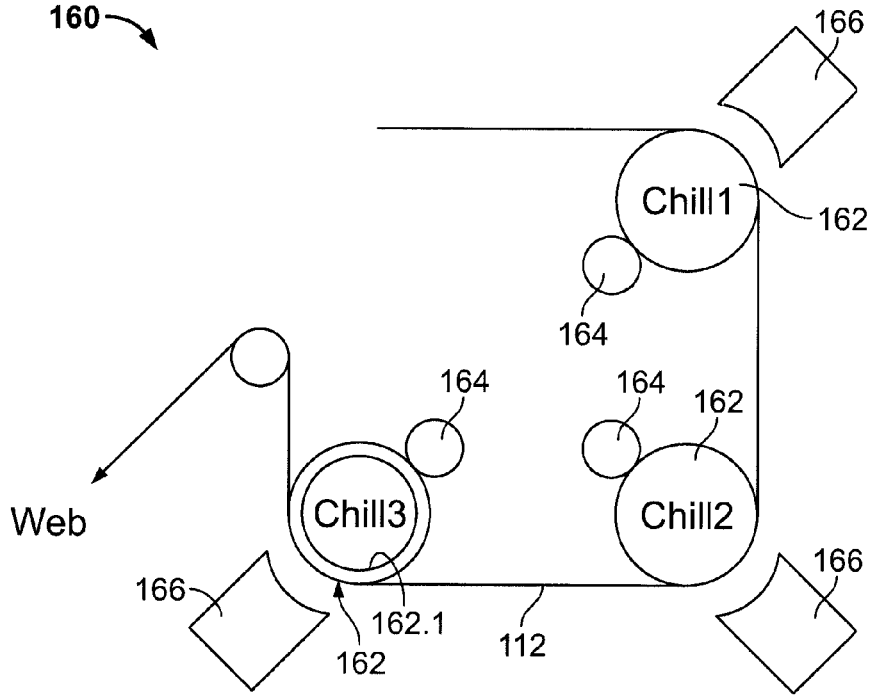
FIG. 4 shows another preferred embodiment of a chiller and spreader roll assembly according to the present invention.

FIG. 4 shows a further preferred embodiment in accordance with the present invention, with similar components bearing similar reference numerals to FIGS. 1-3. Chill/spreader roll assembly 160 includes three trolley rolls 164 and three chill/spreader rolls 162 each having a metal shell 162.1 (shown only for one roll 162 for ease of illustration). Three light sources 166, for example, ultra violet light sources, are also provided. Light sources 166 use light to cure ink on web 112.

A method for chilling and spreading a web is also provided. Roll 62 chills web 12 as web 12 passes over the combination roller. The deflection imparted onto roll 62 by the force of contact from trolley roll 64 causes web 12 to spread over roll 62 thereby reducing fluting and spreading web 12.

A wide variety of actuators can be used to configure trolley roll 64 to impart the desired force, including without limitation, support arm(s), carriage(s), eccentric(s), and frame(s). For example, trolley roll 64 could be mounted for rotation on a pair of fixed supports. Alternatively, the supports may be biased, for example, through the use of springs, pneumatic cylinders, or hydraulic cylinders. With such bias type supports, the force applied to the roll 62 could be adjustable. Such adjustments could be made manually, for example by adjusting the springs, or the hydraulic or pneumatic cylinders, or automatically through the use of a controller. Preferably, pneumatic cylinders are used, and bias force need not be modified from print job to print job.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A roller assembly for spreading and chilling a web in a printing press comprising:

a roller for chilling and spreading a web;

a trolley roller contacting the roller, the trolley roller configured and arranged to impart a deflection in the roller; and a light source positioned to transmit light towards the roller, whereby the light source cures ink on a web as the web passes over the roller.

2. The roller assembly as recited in claim 1, further comprising an actuator connected to the trolley roller, the actuator causing the trolley roller to impart the deflection.

3. The roller assembly of claim 1, wherein a web wraps around the roller, and the trolley roller contacts the roller in an area where the web is not present.

4. The roller assembly recited in claim 1 wherein the trolley roller contacts the roller substantially at a mid-span of the roller.

5. The roller assembly as recited in claim 1 wherein the ends of the roller are not deflected by the contact.

6. The roller assembly as recited in claim 1 wherein the axis of the roller is non-linear under said deflection.

7. The roller assembly as recited in claim 1, wherein the light source is an ultraviolet light source.

8. The roller assembly as recited in claim 1, wherein the roller is a flexible roller having an outside diameter of from about 4 inches to about 10 inches.

9. The roller assembly as recited in claim 8, wherein the flexible roller has an outer shell defining said outside diameter.

10. The roller assembly as recited in claim 9, wherein the outer shell has a wall thickness of about 0.3+/−0.2 inches.

11. The roller assembly as recited in claim 10, wherein the outside diameter is from about 7 inches to about 8 inches.

12. A printing press comprising:

a printing section for printing on a web; and at least one roller assembly as recited in claim 1.

13. The printing press as recited in claim 12, wherein the at least one roller assembly is a plurality of roller assemblies.

14. A method for spreading and chilling a web comprising the steps of:

passing a web over a roller assembly as recited in claim 1.

15. A roller assembly for spreading and chilling a web in a printing press comprising:

a roller for chilling and spreading a web; and a trolley roller contacting the roller, the trolley roller configured and arranged to impart a deflection in the roller;

wherein the roller is a flexible roller having an outside diameter of from about 4 inches to about 10 inches;

wherein the flexible roller has an outer shell defining said outside diameter;

wherein the outer shell has a wall thickness of about 0.3+/−0.2 inches;

wherein the outer shell is made of aluminum.

16. A method for minimizing fluting in a web comprising the steps of:

passing a web over a roller, the roller chilling the web;

contacting the roller with a trolley roller causing the roller to deflect;

spreading the web due to the deflection of the roller; and providing a light source positioned to transmit light towards the roller, whereby the light source cures ink on a web as the web passes over the roller.

17. The method of claim 16, wherein the roller is a flexible roller having an outside diameter of from about 4 inches to about 10 inches, the flexible roller has an outer shell defining said outside diameter, wherein the outer shell has a wall thickness of about 0.3+/−0.2 inches, wherein the outside diameter is from about 7 inches to about 8 inches.

* * * * *